US005275923A

United States Patent [19]

Fyson

[11] Patent Number: 5,275,923

[45] Date of Patent: Jan. 4, 1994

[54] METHOD OF PHOTOGRAPHIC PROCESSING AND FIXER COMPOSITIONS THEREFOR

[75] Inventor: John R. Fyson, London, England

[73] Assignee: Eastman Kodak Company, Rochester, N.Y.

[21] Appl. No.: 2,405

[22] Filed: Jan. 8, 1993

[30] Foreign Application Priority Data

Jan. 10, 1992 [GB] United Kingdom ..... 9200435

[51] Int. Cl.[5] ..... G03C 5/38

[52] U.S. Cl. ..... 430/455; 430/458; 430/459

[58] Field of Search ..... 430/455, 458, 459

[56] References Cited

U.S. PATENT DOCUMENTS

| | | | |
|---|---|---|---|
| 2,735,774 | 2/1956 | Henn | 430/453 |
| 3,854,947 | 12/1974 | Ritchey | 430/427 |
| 3,994,729 | 11/1976 | Shibaoka | 430/420 |
| 4,029,510 | 6/1977 | Speers | 430/428 |
| 4,963,474 | 10/1990 | Fujita et al. | 430/393 |

FOREIGN PATENT DOCUMENTS

| | | |
|---|---|---|
| 430212 | 6/1991 | European Pat. Off. . |
| 431568 | 6/1991 | European Pat. Off. . |
| 458277 | 11/1991 | European Pat. Off. . |
| 2212905 | 9/1973 | Fed. Rep. of Germany . |
| 62-80649 | 4/1987 | Japan . |
| 63-282737 | 11/1988 | Japan . |

OTHER PUBLICATIONS

Abstract of JP3054553 Jul. 1989.

*Primary Examiner*—Hoa Van Le

*Attorney, Agent, or Firm*—Sarah Meeks Roberts

[57] ABSTRACT

A method of reducing the environmental impact of ammonium thiosulfate photographic fixers without increasing fixing time is provided. In the method of the invention, up to 60% molar of the total ammonium thiosulfate is replaced by an alkali metal thiosulfate.

3 Claims, No Drawings

METHOD OF PHOTOGRAPHIC PROCESSING AND FIXER COMPOSITIONS THEREFOR

This invention relates to a method of photographic processing and to fixer compositions for use therein.

The photographic process known as fixing is the processing step in which undeveloped silver halide in a developed silver halide emulsion layer is removed so that further darkening due to reduction of silver halide does not occur. Thiosulphate salts have been widely used for this purpose for many years, initially the sodium salt (usually known as "hypo") and later the ammonium salt. Recently ammonium thiosulphate has been preferred because of the superior speed with which the fixing is accomplished. This use is described in Mees and James "Theory of the Photographic Process", 4th edition, page 443.

From the environmental point of view, ammonium ions are undesirable as they are toxic to aquatic life and encourage eutrophication.

The problem to which the present invention is directed is how to reduce the amount of ammonium ion in photographic fixers without slowing the fixing process down.

U.S. Pat. No. 4,029,510 describes photograpic processing solutions (both developer and fixer) which each contain at least two developing agents and at least two fixing agents respectively. A dry powder fixer composition is described which contains anhydrous sodium sulphite, anhydrous sodium thiosulphate, ammonium chloride and ammonium thiosulphate. This particular combination of the last three compounds appears to be necessary in order to prevent the powder turning into an intractible solid as ammonium thiosulphate does on its own. Also, this formulation is particularly high in ammonium ions due to the additional ammonium chloride present. No explanation of the reason for using more than one developing or fixing agent is given.

According the the present invention there is provided a method of reducing the environmental impact of ammonium thiosulphate photographic fixers without increasing fixing time comprises replacing up to 60% molar of the total ammonium thiosulphate by an alkali metal thiosulphate.

It has been found, surprisingly, that such a considerable replacement of ammonium thiosulphate does not affect the fixing time to any substantial degree.

The present invention further provides a photographic fixer composition comprising ammonium and alkali metal thiosulphates such that at least 60 molar percent of the thiosulphate comprises alkali metal thiosulphate with the proviso that the composition is free from ammonium chloride.

The alkali metal thiosulphate may, for example, be potassium or, preferably, sodium thiosulphate.

The fixer composition also preferably contains sulphite ions as is conventional.

The present fixer composition may comprise, in the working solution less than 50 g/l anhydrous ammonium thiosulphate, preferably from 25 to 60 g/l and more preferably 30 to 50 gl. The composition may also contain at least 60 gl sodium thiosulphate pentahydrate, preferably from 100 to 250 g/l and more preferably from 150 to 230 g/l.

The present fixer compositions may also contain sulphite ions, as is conventional. Preferably the fixer contains sodium sulphite at a concentration such that the working strength solution contains from 2 to 20 g/l sodium sulphite.

The present fixer compositions may be used to fix any type of photographic silver halide materials, eg films or papers. Such materials are described in Research Disclosure Item 308119, December 1989 published by Kenneth Mason Publications, Emsworth, Hants, United Kingdom.

The fixing composition may further contain compounds customarily added to fixer solutions, for example fix accelerators.

The fixing process may take place at any desired temperature, for example between 15° and 35° C.

The following Examples are included for a better understanding of the invention.

EXAMPLE 1

A multilayer 400 ASA speed colour film having silver laydowns of 1.1 g/m$^2$ in the cyan dye image forming unit, 1.6 g/m$^2$ in the magenta dye image forming unit and 1.6 g/m$^2$ in the yellow dye image forming unit having an overall silver iodide percentage of the total halide present of 4.2% was cut into strips. Each strip was then fixed in a model seasoned fixer of the following formula:

| | |
|---|---|
| Total thiosulphate (anhy) | 1.0 molar |
| Sodium sulphite (anhy) | 0.1 molar |
| Silver bromide and silver iodide | 0.04 molar |
| pH adjusted to 6.0 | |

The thiosulphate was added as different mixtures of ammonium and sodium thiosulphates. The silver bromide and iodide ratio was also varied with the total silver halide content being kept constant. This was to simulate a fixer seasoned by films containing differing halide ratios. The maximum amount of iodide in the bromide/iodide mixture was at a molar ratio of 8%.

The test film strips were put in a transparent cell containing the test fixer. The infra-red density of the film was monitored continuously. During the fixing step agitation was carried out by a nitrogen gas burst of 0.5 second every 4 seconds. The fixing time was taken as the first time there was no further decrease in infra-red density. The results are tabulated below.

| Ammonium ion (%) | Fixer Iodide (%) | Fixing Time ± 5 (secs) |
|---|---|---|
| 0 | 2 | 115 |
| 20 | 2 | 85 |
| 40 | 2 | 65 |
| 60 | 2 | 65 |
| 80 | 2 | 65 |
| 100 | 2 | 65 |
| 0 | 4 | 140 |
| 20 | 4 | 80 |
| 30 | 4 | 50 |
| 40 | 4 | 35 |
| 50 | 4 | 35 |
| 60 | 4 | 40 |
| 80 | 4 | 35 |
| 100 | 4 | 35 |
| 0 | 8 | 255 |
| 20 | 8 | 200 |
| 40 | 8 | 145 |
| 60 | 8 | 150 |
| 80 | 8 | 145 |
| 100 | 8 | 140 |

The results show that 40% ammonium fixers are just as fast as 100% ammonium fixers at these levels of iodide. The reduced ammonia fixer would then have 60% less ammonia in the overflow and therefore reduced ammonia in the effluent from the process.

I claim:

1. A method of processing a silver halide photographic material, comprising:

providing a fixing solution comprising ammonium thiosulphate in an amount equivalent to from 25 to 60 g/l anhydrous ammonium thiosulphate and an alkali metal thiosulphate in an amount equivalent to from 100 to 250 g/l of sodium thiosulphate pentahydrate, wherein the fixing solution is free of ammonium chloride, and treating the photographic silver halide material with the fixing solution to remove undeveloped silver halide.

2. A method according to claim 1, wherein the fixing solution comprises ammonium thiosulphate in an amount equivalent to from 30 to 50 g/l anhydrous ammonium thiosulphate and an alkali metal thiosulphate in an amount equivalent to from 150 to 230 g/l of sodium thiosulphate pentahydrate.

3. A method according to claim 1, wherein the alkali metal thiosulphate is sodium thiosulphate.

* * * * *